US005201368A

United States Patent [19]

Kroetsch

[11] Patent Number: 5,201,368

[45] Date of Patent: Apr. 13, 1993

[54] GASKET FOR A TANK AND HEADER ASSEMBLY

[75] Inventor: Karl P. Kroetsch, Williamsville, N.Y.

[73] Assignee: General Motors Corporation, Detroit, Mich.

[21] Appl. No.: 902,267

[22] Filed: Jun. 22, 1992

[51] Int. Cl.[5] ..... F28F 9/00

[52] U.S. Cl. ..... 165/173; 165/149

[58] Field of Search ..... 165/149, 173

[56] References Cited

U.S. PATENT DOCUMENTS

| | | | |
|---|---|---|---|
| 4,305,459 | 12/1981 | Nonnenmann et al. | 165/173 |
| 4,351,390 | 9/1982 | Argyle et al. | 165/149 |
| 4,401,157 | 8/1983 | Cadars | 165/173 |
| 4,485,867 | 12/1984 | Melnyk et al. | 165/173 |
| 4,544,029 | 10/1985 | Cadars | 165/149 |
| 4,881,594 | 11/1989 | Beamer et al. | 165/173 |
| 4,917,182 | 4/1990 | Beamer | 165/173 |
| 4,997,035 | 3/1991 | Beatenbough | 165/173 |

FOREIGN PATENT DOCUMENTS

| | | | |
|---|---|---|---|
| 2353442 | 4/1975 | Fed. Rep. of Germany | 165/173 |
| 3544588 | 6/1987 | Fed. Rep. of Germany | 165/173 |
| 58-148393 | 9/1983 | Japan | 165/173 |
| 2070223 | 9/1981 | United Kingdom . | |

*Primary Examiner*—Allen J. Flanigan
*Attorney, Agent, or Firm*—Patrick M. Griffin

[57] ABSTRACT

A junction (16) includes a gasket (18) between a tank (12) and header (14) of a heat exchanger (10). The gasket has a substantially flat bottom surface (40), a convex upper section (42), and a lip (46) at its inner periphery (44) that extends upwardly. A concave recess (52) is interposed between the convex section and lip. The lip is positioned to fill a crevice (56) formed between the tank and header when the heat exchanger is assembled.

12 Claims, 1 Drawing Sheet

Fig-1
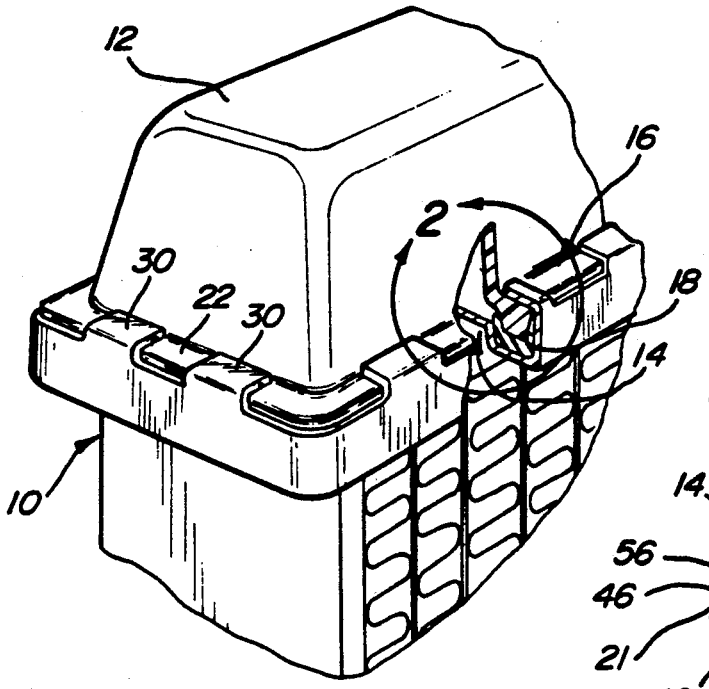
Fig-2
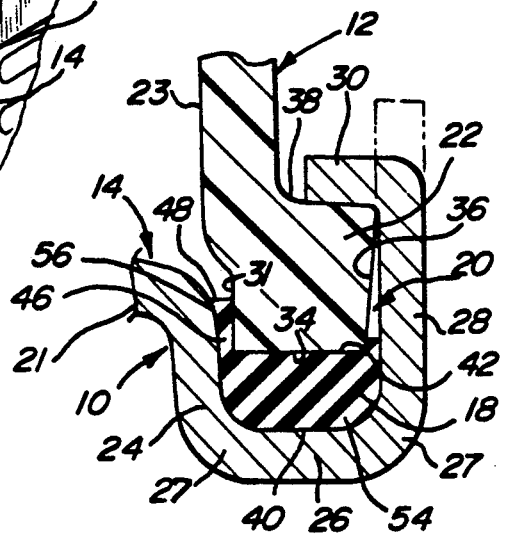
Fig-3
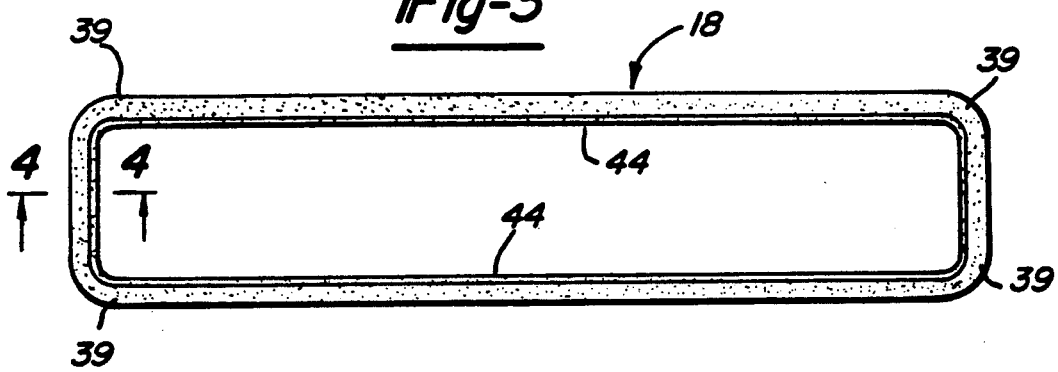
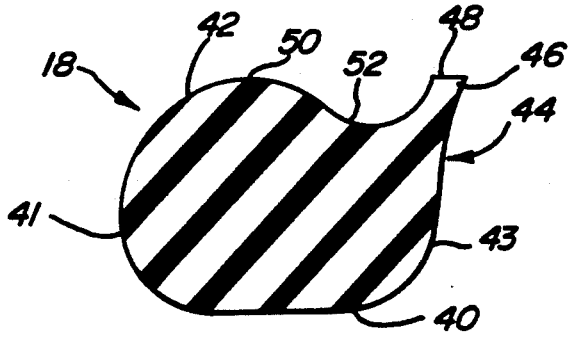
Fig-4

GASKET FOR A TANK AND HEADER ASSEMBLY

TECHNICAL FIELD

The field of this invention relates to heat exchangers and more particularly to seal junctions in a heat exchanger.

BACKGROUND OF THE DISCLOSURE

Heat exchangers are used in the vast majority of motor vehicles that are powered by an internal combustion engine. The heat exchangers are used for engine cooling and passenger compartment heaters. Most heat exchangers include a header and a tank at each end core surface. It has become common practice to manufacture the tank from a plastic material and the header from a heat conductive metal material such as aluminum. The plastic tank is mechanically joined to the header. It is vital that the junction between the tank and header be leak-free and durable in spite of the sometimes corrosive fluid that flows through the heat exchanger. It is also common practice to use elastomeric gaskets in the junction between the tank and header to prevent leakage between the header and tank.

The junction between the tank and header poses a major problem to the durability of the heat exchanger. Usually the junction design has a channel formed in the header to receive edge portions of the tank. An elastomeric gasket is compressed therebetween. In many of these junction designs, a narrow crevice between the tank wall and inner wall of the channel allows fluid to seep therein, but has either limited or no fluid flow therethrough. The narrowness of the crevice prevents the normal washing action of the coolant flow through the crevice. Under certain conditions, particles within the coolant become lodged in the crevice and inside channel section which can initiate crevice corrosion. Eventually, the progression of the crevice corrosion results in a leak in the heat exchanger.

Several efforts have been made to eliminate crevice corrosion. Some of these efforts use extensive redesign of the tank foot to provide flow channels to wash the particles from the inside channel section. Headers have also been manufactured with a zinc alloy or an alloy of aluminum, magnesium and zinc on the inner surfaces exposed to the coolant. These tank foot redesigns and use of the mentioned alloys are expensive attempted corrections but they do not eliminate the basic conditions that instigate crevice corrosion. Both the crevice and the contact of the coolant with the header within the channel remain in these redesigns.

Gaskets have undergone many different designs. Many of these gaskets are used with a tank foot that has a compression rib formed therein. Some gasket designs have been developed with beads to provide sealing forces in the channel. Still other gaskets have been designed to extend into the tank interior. While these gaskets fill the channel and the crevice formed between the tank foot and header channel, they create their own crevices with the header to form other areas of potential corrosion.

What is needed is a gasket with a truncated lip that fills the crevice between the tank foot and inner channel wall but has its distal end under compression between the foot and channel wall so that the coolant is sealed from entering between the gasket and either the header or tank foot.

What is also needed is a sealing gasket that has the convenience of assembly of an 0-ring with increased joint rigidity.

SUMMARY OF THE DISCLOSURE

In accordance with one aspect of the invention, a heat exchanger has a tank sealingly secured to a header. The tank has a foot having an outwardly directed shoulder from a substantially vertical wall. The foot has a lower surface, an outer surface and an inner heel surface. A header is configured to receive the tank foot within a channel. The channel has an outer wall with a bendable end for gripping the foot. The channel has a lower wall spaced from and opposing the lower surface of the flange. The channel has an inner wall also opposing a heel of the foot. The top of the inner wall is connected to an end plate section of the header.

An annular gasket of elastomeric material is seated within the channel. The gasket in its relaxed state has a substantially flat lower surface with rounded corners leading into the side portions and an upper convex section. A lip extends upwardly from a radially inner side portion of said annular gasket and is interposed between the channel inner wall and the tank foot. When the gasket is in its relaxed state, the lip is separated from said upper convex section by a recess interposed therebetween. Preferably, the recess has a concave contour. The lip has its distal end vertically aligned with the upper point of the convex section.

The gasket lower portion is shaped in cross section to conform with the walls of the channel to substantially fill the lower portion of the channel. The gasket when installed in the junction has its lip displaced under compression to extend and fill the crevice between the foot and channel inner wall. The distal end of the lip is in proximity to the heel of the foot and remains under compression between the foot and inner wall of the channel. The distal end preferably remains outboard of the substantially vertical tank wall's inner surface and below the header end plate section.

In accordance with another aspect of the invention, a gasket has the properties hereinabove described.

BRIEF DESCRIPTION OF THE DRAWINGS

Reference now is made to the accompanying drawings in which:

FIG. 1 is a partially segmented perspective view of a tank and header illustrating one embodiment of the invention;

FIG. 2 is an enlarged segmented view of the junction shown in FIG. 1;

FIG. 3 is a plan view of the annular gasket shown in FIG. 1; and

FIG. 4 is an enlarged cross-sectional view taken along the line 4—4 shown in FIG. 3.

DETAILED DESCRIPTION OF THE PREFERRED EMBODIMENT

Referring now to FIG. 1, a heat exchanger 10 has a tank 12 joined to a header 14 at junction 16 that includes gasket 18. As shown more clearly in FIG. 2, the header 14 includes an end plate section 21 having a peripheral channel 20 sized to receive a foot 22 of the tank 12. The channel 20 includes an inner wall 24, lower wall 26, and outer wall 28. The walls are joined at rounded corners 27. The distal end 30 of wall 28 is bendable to grip the foot 22.

The tank 12 has a substantially vertical inner wall surface 23. The foot 22 extends outwardly from wall surface 23 and has a heel section 31 that opposes inner wall 24 of channel 20. The foot 22 also includes a lower surface 34, outer surface 36 and upper grip surface 38. The foot 22 is sized to be received in the channel 20 along with the gasket 18. The foot 22 is positioned downwardly into channel 20 to compress the gasket 18. The distal end 30 of wall 28 is clinched about grip surface 38 to affix the tank 12 in place with compressed gasket 18.

The gasket 18 is shown in it relaxed state in FIGS. 3 and 4. As shown in FIG. 3, the gasket 18 has a generally annular ring configuration which resembles a rectangle with rounded corners 39 to configure with the shape of most tanks and headers. However, other annular shapes are possible to fit other shaped tanks and headers. As shown in FIG. 4, the gasket 18 has a substantially flat lower surface 40, side wall portions 41 and 43, and a convex upper section 42. The lower half of side wall portions 41 and 43 and the lower surface 40 are shaped to conform to the cross-sectional shape of the lower portion of channel 20. The inner periphery 44 of the annular gasket 18 includes an upwardly extending lip 46. The lip 46 extends upwardly such that its distal end 48 is approximately vertically aligned with an uppermost extent 50 of the convex upper section 42. The lip 46 is separated from the convex upper section 42 by a recess 52 interposed therebetween. The recess 52 has a generally concave contour.

When the gasket 18 is installed in the channel 20, the side wall portions 41 and 43 with lower surface 40 substantially fill the lower half of channel 20. The foot 22 is installed and compresses the gasket 18 to flatten the convex upper surface 42. The lip 46 is positioned and compressed in the crevice 56 that is formed between the heel section 31 and the inner wall 24 of channel 20.

The gasket material is deformed and flows to substantially fill the space 54 within the channel below the foot. The gasket 18, the foot 22, and the channel 20 are designed to allow sufficient volume for gasket deformation during assembly so that the channel space 54 is filled. The gasket 18 is compressed by approximately 30% when the foot is affixed within channel 20. The lip 46 is extruded into the crevice 56 during its compression. The distal end 48 of lip 46 is in proximity to the heel 31 and is retained in compression between the heel 31 and the inner wall 24 of channel 20. The distal end 48 remains positioned below end plate 25 and outboard of wall surface 23. The position of end 48 of lip 46 provides that the lip 46 is retained in compression to reduce the possibility that another crevice may form between the lip 46 and either the foot 22 or channel wall 24.

In this manner, the source of the crevice corrosion is eliminated by eliminating the crevice that is filled with corrosive coolant. Furthermore, the junction has increased rigidity compared to a junction using a comparable 0-ring gasket because of the greater force required to obtain optimum compression of the gasket.

Furthermore, because more force is necessary to compress the gasket, there is also an increased residual reactionary force within the junction to provide more reliable sealing capability across the width of the channel. The compression of gasket 18 results in the seal compression forces pushing against substantially all areas of wall contact. The improved seal compression reduces the chances of leakage due to irregularities within the gasket or foreign particles and debris settling on the tank and header mating surfaces. Manufacture of the design is facilitated with compression of approximately 30% being consistently achieved.

Variations and modifications are possible without departing from the scope and spirit of the present invention as defined by the appended claims.

The embodiments in which an exclusive property or privilege is claimed are defined as follows:

1. In a heat exchanger having a tank sealingly secured to a header by a seal assembly, the seal assembly characterized by:

a tank foot at an end of said tank, said foot being outwardly directed from a vertical wall of said tank and having a lower surface, outer surface, upper surface and inner heel section;

a header configured to receive the tank foot having an end plate section with a peripheral channel;

said channel having an outer bendable wall for gripping the foot, an inner wall opposed to the heel, and a bottom surface being opposed to and spaced from said lower surface of said foot;

an annular gasket of elastomeric material having a convex upper section compressed between the bottom surface of said channel and said foot, a truncated lip at an inner side of said annular gasket interposed between said inner wall of said channel and the heel section of said foot, said lip being separated from said convex upper section when said gasket is in a relaxed state by a recess interposed between said lip and said convex upper section, and when installed, being positioned below said end plate section of said header and outboard of an inner surface of said vertical wall of said tank.

2. A seal assembly as defined in claim further characterized by:

said lip and said convex section when in said relaxed state extend substantially the same height.

3. A seal assembly as defined in claim 2 further characterized by:

said recess being in the form of a concave contour.

4. A seal assembly as defined in claim 1 wherein a bottom portion of said gasket conforms in shape to a cross-sectional shape of said channel formed by said bottom surface, outer bendable wall and inner wall of said channel.

5. A seal assembly as defined in claim 4 further characterized by said channel and said gasket having substantially flat bottom surfaces, respectively.

6. A sealing gasket for a heat exchanger tank and header, said gasket characterized by:

an annular ring of elastomeric material having a substantially flat lower surface, a convex upper surface and an a lip at a radially inner edge of said ring;

said lip and convex upper surface separated by a recess interposed between said lip and said convex upper surface.

7. A sealing gasket as defined in claim 6 further characterized by:

said recess being in the form of a concave contour.

8. A sealing gasket as defined in claim 6 further characterized by:

said lip having an upper edge substantially aligned with an upper extent of said convex surface.

9. A sealing gasket as defined in claim 8 further characterized by:

said recess being in the form of a concave contour.

10. In a heat exchanger having a tank sealingly secured to a header, a seal assembly characterized by:

a tank foot at an end of said tank, said foot having an outwardly directed flange with a lower surface, and an outer surface and an inner heel section;

a header configured to receive the tank foot and having a channel with an outer wall for gripping the foot, an inner wall opposed to the heel section, and a bottom surface opposed to and spaced from said tank foot lower surface;

an annular gasket of elastomeric material having an upper convex section when in its relaxed state, the lower portion having a cross section when in its relaxed state to conform to a cross-sectional shape of a lower portion of said channel, said gasket having a truncated lip at an inner side thereof and being interposed between said heel of said foot and the inner wall of said channel;

a distal end of said lip being retained in compression between said heel section and said inner wall of said channel.

11. A seal assembly as defined in claim 10 further characterized by:

said lip and convex upper surface are separated by a recess interposed between said lip and said convex upper surface.

12. A seal assembly as defined in claim 11 further characterized by:

said recess being in the form of a concave contour.

* * * * *